US008120541B2

(12) United States Patent
Jung et al.

(10) Patent No.: US 8,120,541 B2
(45) Date of Patent: Feb. 21, 2012

(54) ANTENNA SYSTEM FOR TRACKING SATELLITE

(75) Inventors: Young-Bae Jung, Daejon (KR); Soon-Young Eom, Daejon (KR); Jae-Seung Yun, Daejon (KR); Seong-Ho Son, Daejon (KR); Soon-Ik Jeon, Daejon (KR); Chang-Joo Kim, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 826 days.

(21) Appl. No.: 12/096,786

(22) PCT Filed: Dec. 11, 2006

(86) PCT No.: PCT/KR2006/005375
§ 371 (c)(1),
(2), (4) Date: Jun. 9, 2008

(87) PCT Pub. No.: WO2007/067016
PCT Pub. Date: Jun. 14, 2007

(65) Prior Publication Data

US 2008/0297427 A1 Dec. 4, 2008

(30) Foreign Application Priority Data

Dec. 9, 2005 (KR) ..... 10-2005-0120461

(51) Int. Cl.
*H01Q 3/00* (2006.01)

(52) U.S. Cl. ..... 343/766; 343/765

(58) Field of Classification Search ..... 343/757, 343/765, 766
See application file for complete search history.

(56) References Cited

U.S. PATENT DOCUMENTS 5,089,824 A 2/1992 Uematsu et al.
5,419,521 A 5/1995 Matthews
6,486,845 B2 * 11/2002 Ogawa et al. ..... 343/765
(Continued)

FOREIGN PATENT DOCUMENTS

JP 01-261005 10/1989
(Continued)

OTHER PUBLICATIONS

"A Satellite-Tracking K- and Ka-Band Mobile Vehicle Antenna System" in IEEE Transactions on Vehicular Technology, vol. 42, No. 4, pp. 502-513, 1993.

(Continued)

*Primary Examiner* — Tan Ho
(74) *Attorney, Agent, or Firm* — Kile Park Goekjian Reed & McManus PLLC

(57) ABSTRACT

Provided is an antenna system for tracking a satellite which includes a fixed body and a rotating body. The antenna system includes a transmitting/receiving unit having a transmitting channel and a receiving channel for signal power, a driving unit for enabling mechanical motion of the rotating body for satellite tracking, and a control unit for monitoring and controlling the operation of the driving unit. Accordingly, the various kinds of the components of the antenna system mounted and operated on the movable body can be minimized and the output of the transmitted signal required in the antenna system can be simply replaced, thereby simplifying the configuration of the system and reducing the production cost of the system. In addition, the STR having the tracking signal processing function in the digital mode as well as the general analog mode is mounted on the antenna system, thereby improving accuracy of satellite tracking. Moreover, the posture of the antenna system can be stably maintained regardless of the motion of the movable body in the moving environment by using the driving unit and the control unit which are designed for stably controlling the elevation, azimuth and antenna rotating angle, thereby improving communication performance that is the intrinsic object of the antenna system.

6 Claims, 4 Drawing Sheets

U.S. PATENT DOCUMENTS

| | | | | |
|---|---|---|---|---|
| 6,577,281 | B2 * | 6/2003 | Yamamoto et al. | 343/766 |
| 6,657,589 | B2 | 12/2003 | Wang et al. | |
| 6,914,578 | B1 | 7/2005 | Menahem | |
| 2005/0280593 | A1 * | 12/2005 | Cha et al. | 343/757 |
| 2008/0186242 | A1 * | 8/2008 | Shuster et al. | 343/762 |

FOREIGN PATENT DOCUMENTS

| | | |
|---|---|---|
| JP | 01-303903 | 12/1989 |
| JP | 01-304509 | 12/1989 |
| JP | 02-124603 | 11/1990 |
| JP | 2005-300347 | 10/2005 |
| KR | 10-1992-0010206 | 11/1992 |
| KR | 10-2002-0054179 | 7/2008 |

OTHER PUBLICATIONS

International Search Report for corresponding to PCT/KR2006/005375 Dated Mar. 19, 2007.

* cited by examiner

[Fig. 1]
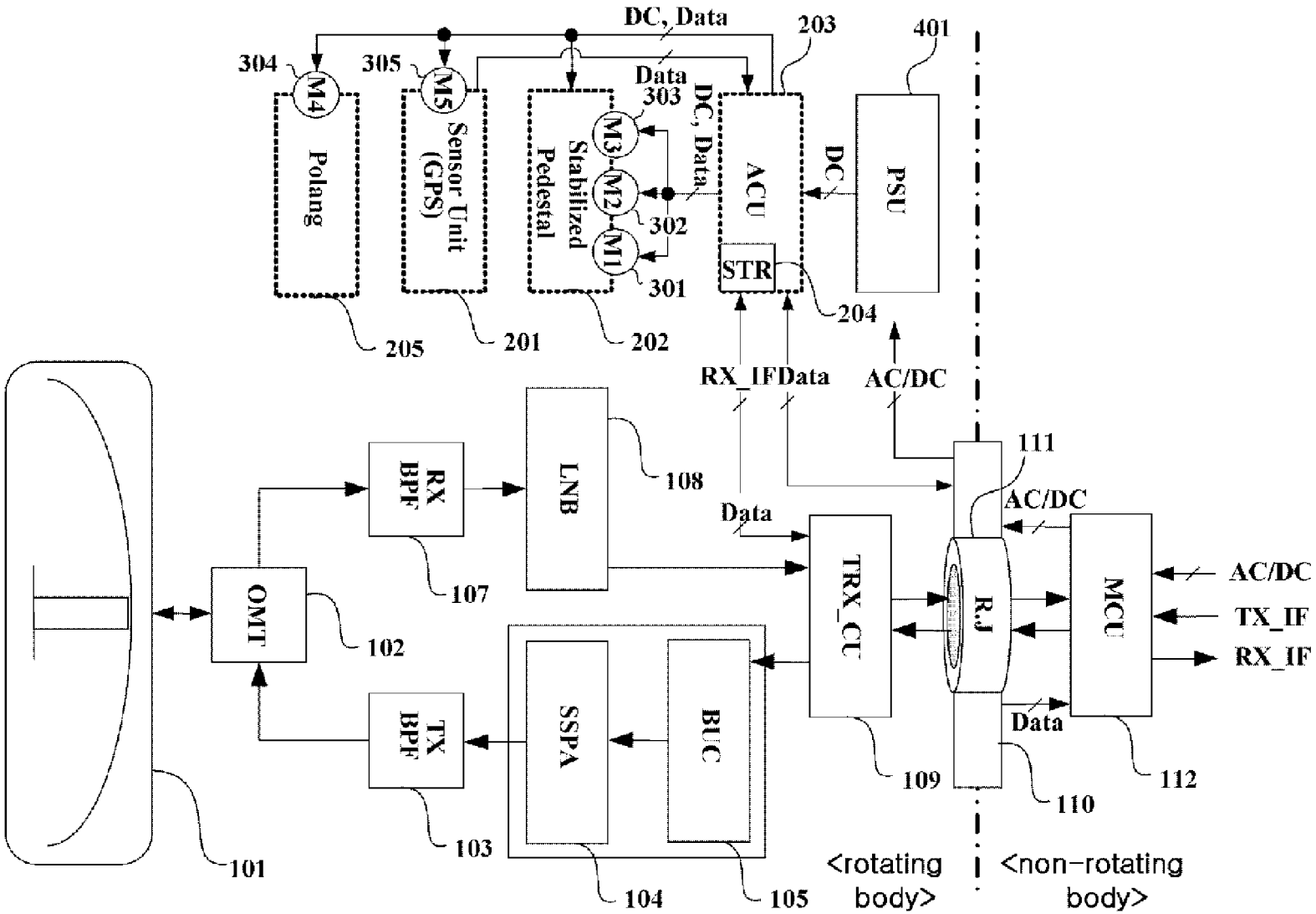

[Fig. 2]
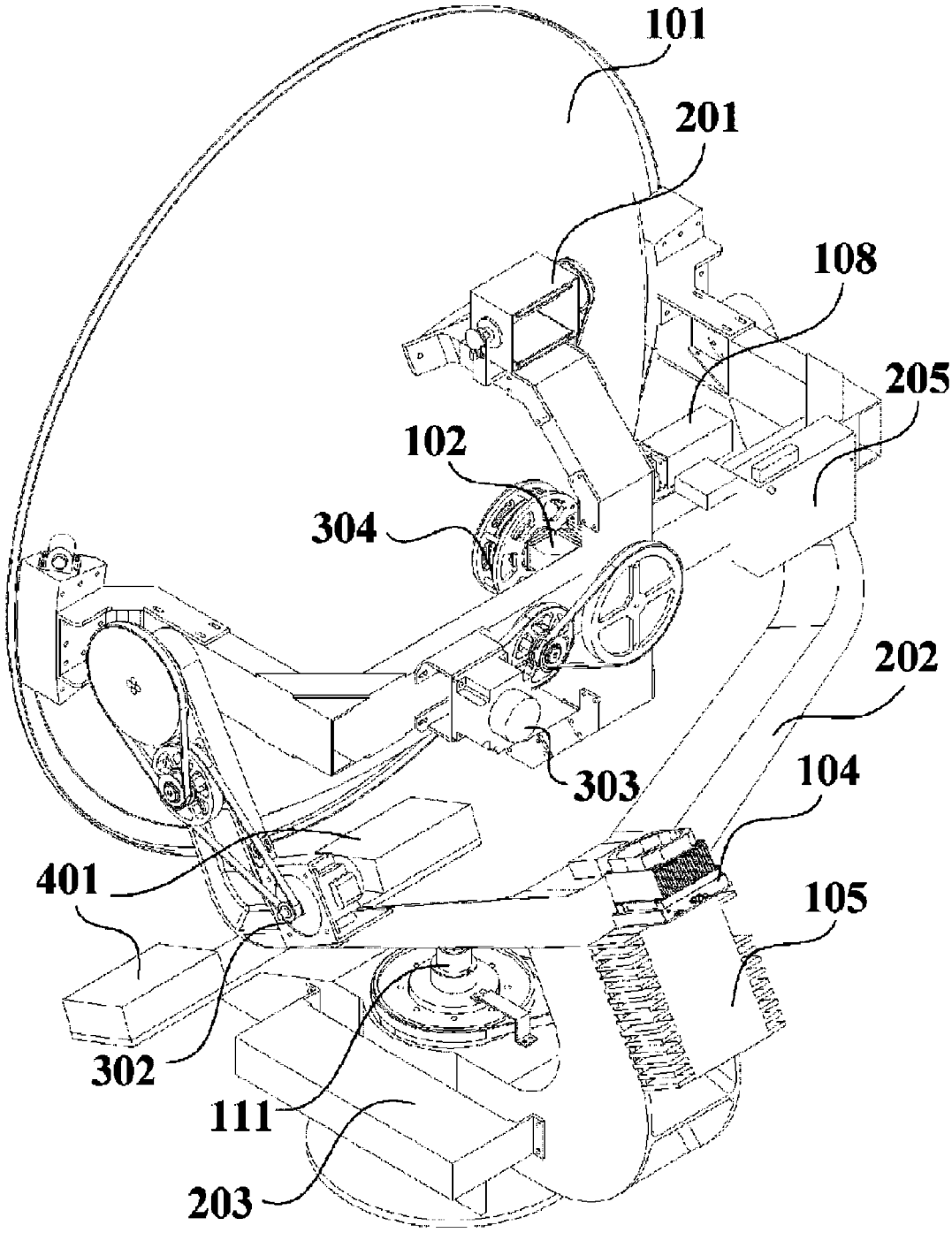

[Fig. 3]
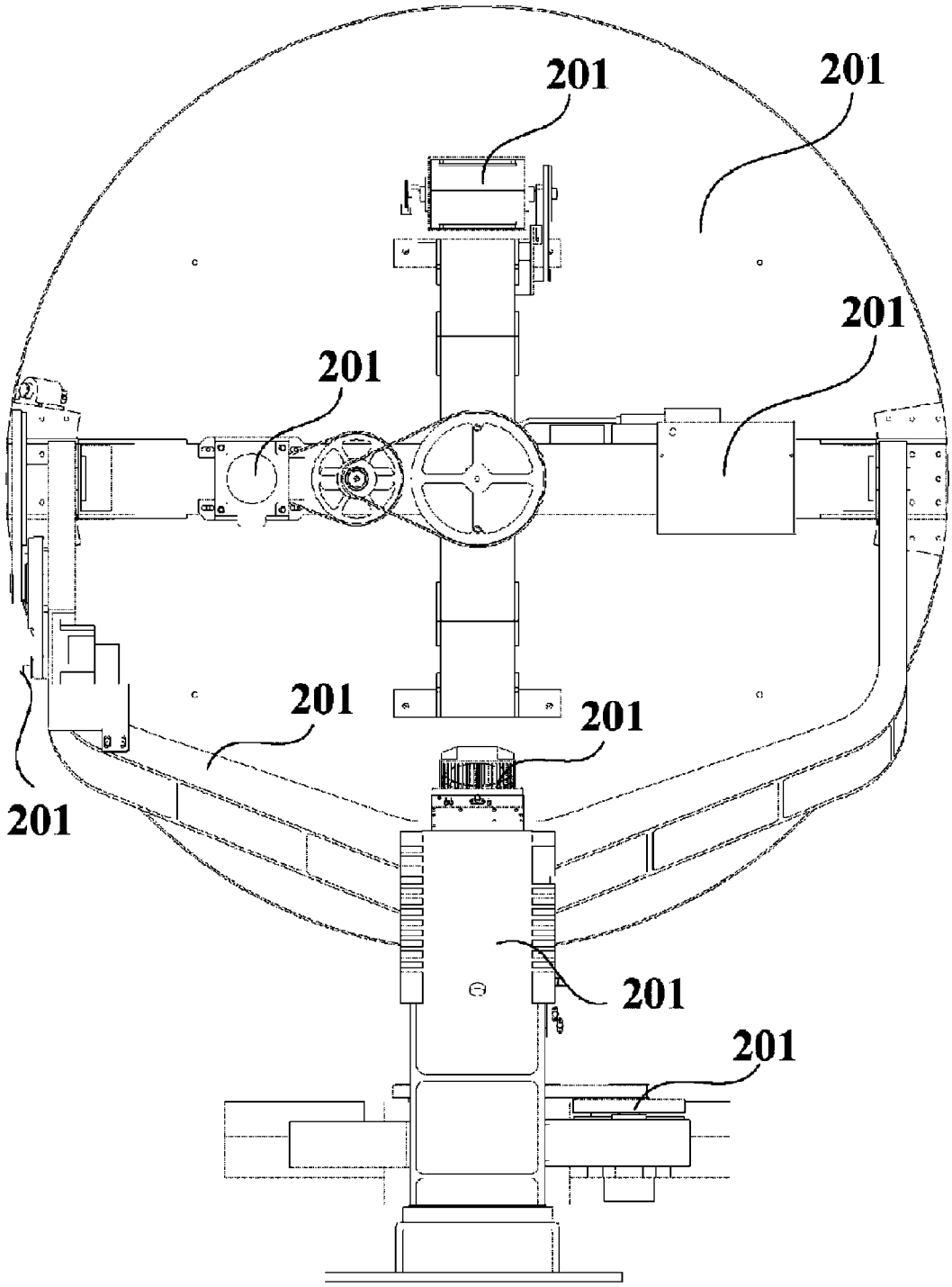

[Fig. 4]
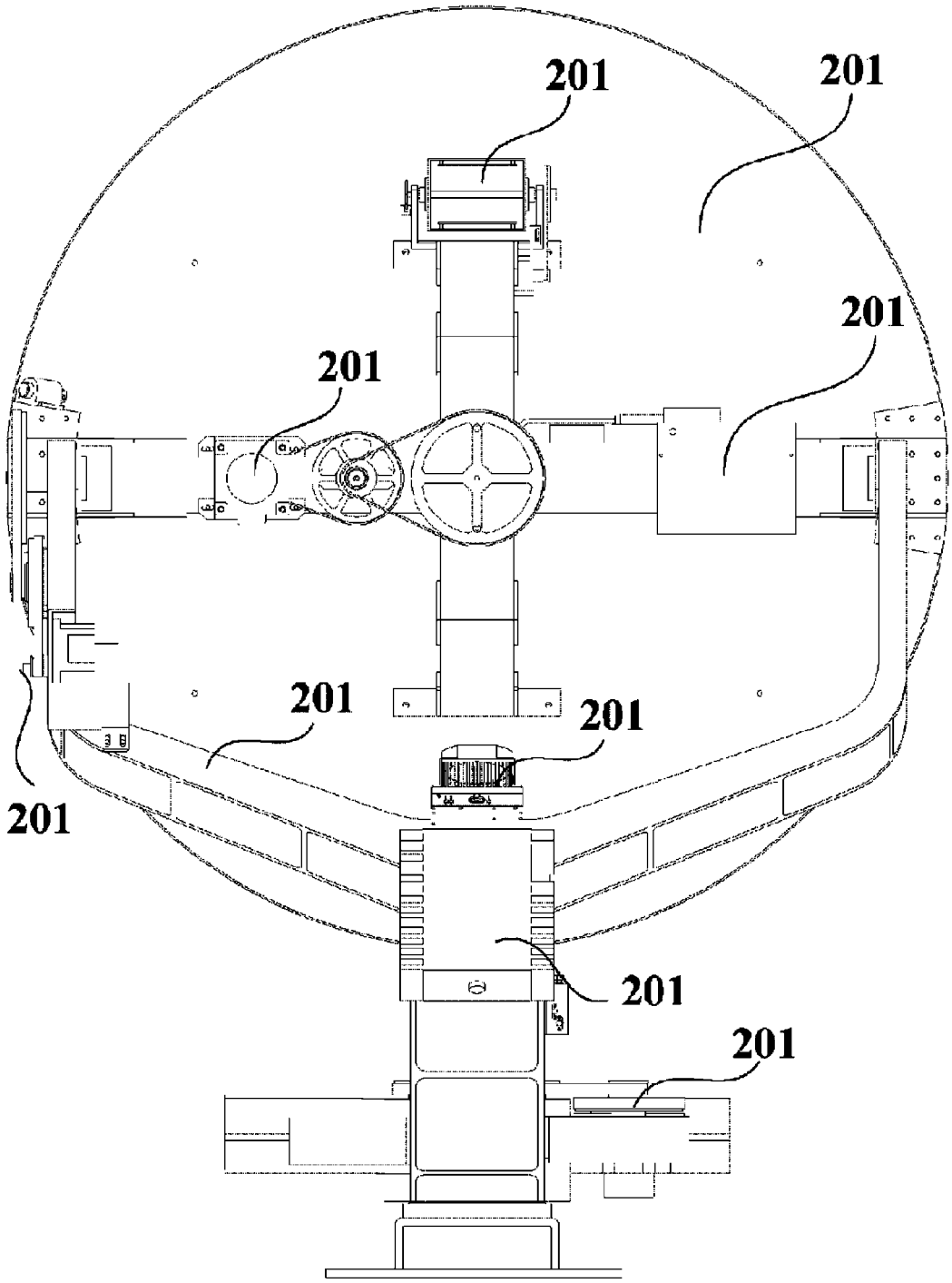

ANTENNA SYSTEM FOR TRACKING SATELLITE

TECHNICAL FIELD

The present invention relates to an antenna system for tracking a satellite; and, more particularly, to a satellite tracking antenna system which is capable of reducing the production cost, easily changing system performance when necessary, and improving accuracy of satellite tracking by optimizing functions and performance of signal power transmission and reception and mechanical satellite tracking through efficient implementation of components included in the antenna system.

BACKGROUND ART

In general, when a conventional antenna system for tracking a satellite performs electronic or semi-electronic satellite tracking, the production cost of the system is increased. Further, since the antenna system performs only 2-axis control in azimuth and elevation directions, it cannot precisely track the satellite if a beam width of an antenna is narrow.

In addition, the conventional antenna system performs simple 3-axis control even when it carries out mechanical satellite tracking. Therefore, the conventional antenna system has a structural limitation that cannot appropriately cope with a satellite polarization angle error generated by a position variation of a movable body on which it is mounted, and a satellite-oriented angle error generated by a latitude variation.

Moreover, in order to reduce the size of the antenna system, a method in which all components that must be mounted thereon are disposed outside has been used. In such a case, however, there exists an inconvenience of making all the supplementary components mounted on the movable body on which the antenna system is mounted.

DISCLOSURE

Technical Problem

It is, therefore, an object of the present invention to provide a satellite tracking antenna system which is capable of reducing the production cost, easily changing system performance when necessary, and improving accuracy of satellite tracking, by optimizing functions and performance of signal power transmission and reception and mechanical satellite tracking through efficient implementation of components included in the antenna system.

Technical Solution

In accordance with one aspect of the present invention, there is provided an antenna system for tracking a satellite, which comprises a fixed body for transmitting and receiving communication and broadcasting signals to/from an external terminal system and receiving AC power from an external source, and a rotating body rotatably coupled to the fixed body in multi-axis directions for tracking a direction of the satellite, and transmitting and receiving signal power to/from the satellite through a free space, wherein the antenna system comprises: a transmitting/receiving unit having a transmitting channel and a receiving channel for signal power; a driving unit for enabling mechanical motion of the rotating body for satellite tracking; and a control unit for monitoring and controlling the operation of the driving unit.

Further, it is preferred that the transmitting channel includes a rotary joint for providing a channel between the rotating body and the fixed body; a TRX common unit for controlling on and off through a built-in RF switch; a block up converter for frequency up-converting an inputted baseband signal into an RF band signal; and a power amplifier for amplifying the RF signal from the block up converter to a high output.

Also, it is preferred that the receiving channel includes a rotary joint for providing a channel between the rotating body and the fixed body; a low noise block for low noise amplifying signal power received through an antenna; and a TRX common unit for power-dividing the received signal through a built-in divider and outputting the divided signals to the rotary joint and the control unit, respectively, for performing demodulation of the received signal and satellite tracking by using the received signal.

Furthermore, it is preferred that the driving unit includes: an azimuth motor for driving the antenna system in an azimuth direction; an elevation motor for driving the antenna system in an elevation direction; an antenna rotating motor for rotating the antenna itself to compensate for a polarization error generated by a relative position of the antenna system to the satellite; a feed horn rotating motor for compensating for a polarization angle error of the antenna system mounted on a movable body generated by irregular motion of the movable body; and a latitude compensating motor for compensating for a variation of a satellite-oriented angle of the antenna generated when the movable body on which the antenna system is mounted moves in a latitude direction.

Moreover, it is preferred that the control unit includes a sensor unit having: a rate sensor for sensing an angular velocity to the motion of the antenna system; a tilt sensor for sensing a tilted declination of the antenna system; and a gyrocompass for measuring an azimuth by using a magnetic operating principle, the control unit transmitting the information sensed by the rate sensor, the tilt sensor and the gyrocompass to an antenna control unit which controls the azimuth motor, the elevation motor and the antenna rotating motor contained in the driving motor based on the information so that the antenna system can be oriented toward the satellite in real time.

In addition, it is preferred that a GPS is installed inside or outside the sensor unit for transmitting position information from the satellite to the antenna control unit, and the antenna control unit checks a position of the antenna system and a relative direction of the satellite by using the position information, and controls the antenna rotating motor and the feed horn rotating motor for polarization control.

In accordance with another aspect of the present invention, there is provided an antenna system for tracking a satellite, comprising: an analog mode of directly converting satellite signal power received through an antenna into DC current, and processing the converted DC current in real time; and a digital mode of converting the satellite signal power received through the antenna into a digital signal, and processing the converted digital signal in real time.

The other objectives and advantages of the invention will be understood by the following description and will also be appreciated by the embodiments of the invention more clearly. Further, the objectives and advantages of the invention will readily be seen that they can be realized by the means and its combination specified in the claims.

DESCRIPTION OF DRAWINGS

The above and other objects and features of the present invention will become apparent from the following description of the preferred embodiments given in conjunction with the accompanying drawings, in which:

FIG. 1 is a structural view illustrating an antenna system for tracking a satellite in accordance with a preferred embodiment of the present invention;

FIG. 2 is a perspective view illustrating the rear left side of the antenna system for tracking the satellite in accordance with the present invention;

FIG. 3 is a perspective view illustrating the rear right side of the antenna system for tracking the satellite in accordance with the present invention; and FIG. 4 is a cross-sectional view illustrating the rear portion of the antenna system for tracking the satellite in accordance with the present invention.

BEST MODE FOR THE INVENTION

Hereinafter, a satellite tracking antenna system in accordance with a preferred embodiment of the present invention will be set forth in detail with reference to the accompanying drawings.

FIGS. 1 through 4 are structural views illustrating an antenna system for tracking a satellite in accordance with the present invention. That is, FIG. 1 is a structural view illustrating the antenna system for tracking the satellite, FIG. 2 is a perspective view illustrating the rear left side of the antenna system for tracking the satellite, FIG. 3 is a perspective view illustrating the rear right side of the antenna system for tracking the satellite, and FIG. 4 is a cross-sectional view illustrating the rear portion of the antenna system for tracking the satellite.

Referring to FIG. 1, the antenna system for tracking the satellite according to the invention basically includes a fixed body (non-rotating body) for transmitting and receiving communication and broadcasting signals to/from an external terminal system, and receiving AC power from an external source, and a rotating body rotatably coupled to the fixed body in multi-axis directions for tracking a direction of the satellite, and transmitting and receiving signal power to/from the satellite through a free space. The antenna system for tracking the satellite further includes a transmitting/receiving unit having a transmitting channel and a receiving channel for signal power, a driving unit for enabling mechanical motion of the rotating body for satellite tracking, and a control unit for monitoring and controlling the operation of the driving unit.

In the above antenna system, a transmitting channel includes: a Rotary Joint (RJ) 110 for providing a channel between the rotating body and the fixed body (non-rotating body); a Transceiver (TRX) Common Unit (TRX_CU) 109 for controlling on and off through a built-in RF switch; a Block Up Converter (BUC) 105 for frequency up-converting an inputted baseband signal (intermediate frequency) into an RF band signal; and a Solid State Power Amplifier (SSPA) 104 for amplifying the RF signal from the BUC 105 to a high output. And, a receiving channel includes: the RJ 110 for providing the channel between the rotating body and the fixed body (non-rotating body); a Low Noise Block (LNB) 108 for low noise amplifying a signal power inputted via an antenna 101; and the TRX_CU 109 for power-dividing the input signal through a built-in divider, and outputting the divided signals to the RJ 110 and the control unit, to thereby perform demodulation of the received signal and satellite tracking using the received signal.

The transmitting/receiving unit will now be described in detail.

The antenna 101 is disposed at one side of the system for transmitting and receiving the signal power to/from the free space, and a Monitoring and Control Unit (MCU) 112 is disposed at the other side of the system for intermediating an RF signal, a power and a control signal between the antenna system and the external terminal system. The MCU 112 can be selectively disposed inside or outside the antenna system.

A transmitted signal, a baseband signal (intermediate frequency) is inputted from the external terminal system to the MCU 112, and transmitted to the antenna 101 through the RJ 110 disposed at the boundary between the fixed body (non-rotating body) and the rotating body of the antenna system, the TRX_CU 109, the BUC 105, the SSPA 104, a TX Band Pass Filter (TX BPF) 103 and an Ortho Mode Transducer (OMT) 102.

To be more specific, the RJ 110 serves to provide the channel between the rotating body and the fixed body with respect to the RF and IF signals. In FIG. 1, the right side of the RJ 110 shows the fixed body of the antenna system, and the left side of the RJ 110 shows the rotating body of the antenna system.

Differently from the structure of the general antenna system, it is designed in a manner that the SSPA 104 included in the transmitting channel is disconnected from the BUC 105. Therefore, not the whole BUC 105 but the SSPA 104 can be replaced according to the transmitted signal output specification required in the system. That is, there is a structural advantage of easily adjusting the system specification.

In addition, the transmitting and receiving channels are individually configured in the TRX_CU 109. The transmitting channel of the TRX_CU 109 includes a switch module for turning on and off the transmitting function of the antenna system.

A received signal is inputted from the free space to the antenna 101, and transmitted to the MCU 112 through the OMT 102, the RX BPF 107, the LNB 108, the TRX_CU 109 and the RJ 110. The signal power inputted to the MCU 112 is outputted back to the external terminal system, and passes through signal demodulation. The receiving channel of the TRX_CU 109 divides the signal power from the LNB 108, and outputs each divided signal to the RJ 110 and a Satellite Tracking Receiver (STR) 204 prepared in an Antenna Control Unit (ACU) 203. Here, the signal outputted to the RJ 110 is transmitted to the external terminal system through the MCU 112, and used for signal demodulation; and the signal outputted to the STR 204 is utilized for the antenna system to track the direction of the satellite.

The above-mentioned RF components are adhered to a support structure of the antenna system. The support structure functions to always maintain the antenna system in a stabilized posture in spite of disturbances such as vibration and impact generated outside the antenna system. Thus, it is called a stabilized pedestal 202 in the present invention.

On the other hand, the driving unit of the invention includes: an azimuth motor 301 for driving the antenna system in an azimuth direction; an elevation motor 302 for driving the antenna system in an elevation direction; an antenna rotating motor 303 for rotating the antenna 101 itself to compensate for a polarization error generated by a relative position of the antenna system to the satellite; a feed horn rotating motor 304 for compensating for a polarization angle error of the antenna system mounted on the movable body generated by irregular motion of the movable body; and a latitude compensating motor 305 for compensating for a variation of a satellite-oriented angle of the antenna 101 generated when the movable body on which the antenna system is mounted moves in a latitude direction. The control unit serves to orient the antenna system toward the satellite in real time by controlling the azimuth motor 301, the elevation motor 302 and the antenna rotating motor 303 of the driving unit. The control unit includes a sensor unit 201 comprised of: a rate sensor for sensing an angular velocity to the motion of the antenna system; a tilt sensor for sensing a tilted declination of the antenna system; and a gyrocompass for measuring an azimuth by using a magnetic operating principle. The control unit transmits the information sensed by the rate sensor, the tilt sensor and the gyrocompass to the ACU 203.

In the arrangement, a Global Positioning System (GPS) is installed inside or outside the sensor unit 201 for transmitting position information received from the satellite to the ACU 203. Then, the ACU 203 checks a position of the antenna system and a relative direction of the satellite by using the position information, and controls the antenna rotating motor 303 and the feed horn rotating motor 304 for polarization control.

In addition to the transmitting and receiving unit constituting the antenna system, the configuration of the driving unit and the control unit will now be explained in more detail.

A control signal generated by the MCU 112 and power (AC/DC in FIG. 1) transmitted from the external terminal system to the MCU 112 are outputted to the ACU 203 and a Power Supply Unit (PSU) 401 disposed at the rotating body through a slip ring 111. The PSU 401 converts the AC power inputted from the fixed body into DC power or generates new DC power by using the inputted DC power, and serves to supply the DC power to all components needing such power. The ACU 203 performs the overall control function such as mechanical driving of the antenna system, and signal power variations or output signal on and off functions of the transmitting and receiving channels, namely, the RF channels.

As described above, in order to control driving of the antenna system, the ACU 203 is connected to the five motors disposed at the stabilized pedestal 202, the sensor unit 201 and a polang 205, and provides the DC power and the control signals.

The three motors disposed at the stabilized pedestal 202 are represented by M1 301, M2 302 and M3 303. The M1 301 denotes the azimuth driving motor of the antenna system, the M2 302 denotes the elevation driving motor, and the M3 303 denotes the antenna rotating motor for rotating the antenna 101 itself in the azimuth direction in order to compensate for the polarization error generated by the relative position of the antenna 101 to the satellite. In addition to the antenna rotating motor M3 303, another motor for compensating for the polarization angle is the feed horn rotating motor M4 304 disposed at the polang 205. However, unlike the antenna rotating motor M3 303, the feed horn rotating motor M4 304 compensates for the polarization angle error of the antenna system mounted on the movable body generated by irregular motion of the movable body.

At last, the latitude compensating motor M5 305 is disposed at the sensor unit 201. The latitude compensating motor M5 305 compensates for the variation of the satellite-oriented angle of the antenna 101 generated while the movable body on which the antenna system is mounted moves in the latitude direction. Accordingly, when the antenna system is positioned in a region having a predetermined latitude, the latitude compensating motor M5 305 continuously compensates for the angle so that the satellite-oriented angle in the latitude can be always a reference elevation of the antenna 101.

The rate sensor, the tilt sensor, the gyrocompass and the GPS are built in the sensor unit 201 in which the latitude compensating motor M5 305 is positioned. Here, the rate sensor senses the angular velocity to the motion of the antenna system, the tilt sensor senses the tilted declination of the antenna system, and the gyrocompass measures the azimuth by using the magnetic operating principle. The information sensed by each sensor is transmitted to the ACU 203. Based on the information, the ACU 203 controls the azimuth motor M1 301, the elevation motor M2 302 and the antenna rotating motor M3 303 so that the antenna system can be oriented toward the satellite in real time. In addition, the position information is transmitted from the satellite to the ACU 203 by using the GPS built in the sensor unit 201. The ACU 203 checks the current position of the antenna system and the relative direction of the satellite by using the position information, and controls the antenna rotating motor M3 303 and the feed horn rotating motor M4 304 for polarization control.

FIGS. 2, 3 and 4 illustrate one example of the antenna system for tracking the satellite in accordance with the invention as shown in FIG. 1. Referring to FIGS. 2, 3 and 4, the antenna system is configured in such a way that the rotating body is disposed at the upper portion and the fixed body is disposed at the lower portion on the basis of the RJ 110.

As mentioned above, the support structure of the antenna system on which the components are disposed is called the stabilized pedestal 202. The components can be disposed on the pedestal 202 in various types depending on the shape of the system.

On the other hand, the antenna system for tracking the satellite in accordance with the invention includes both an analog mode and a digital mode.

That is, the STR 204 installed in the ACU 203 is characterized in that it can be operated both in the analog mode of directly converting signal power received from the TRX_CU 109 into DC current and processing the converted DC current, and in the digital mode of converting an inputted analog signal into a digital signal and processing the converted digital signal. Accordingly, in case where the STR 204 is operated in the digital mode, the antenna system shows high satellite tracking performance since the digital mode is more accurate in signal analysis than the analog mode.

As discussed earlier, in accordance with the present invention, the various kinds of the components of the antenna system mounted and operated on the movable body can be minimized and the output of the transmitted signal required in the antenna system can be simply replaced, thereby simplifying the configuration of the system and reducing the production cost of the system. In addition, the STR having the tracking signal processing function in the digital mode as well as the general analog mode is mounted on the antenna system, thereby improving accuracy of satellite tracking. Moreover, the posture of the antenna system can be stably maintained regardless of the motion of the movable body in the moving environment by using the driving unit and the control unit which are designed for stably controlling the elevation, azimuth and antenna rotating angle, thereby improving communication performance that is the intrinsic object of the antenna system.

The present application contains subject matter related to Korean patent application No. 2005-120461, filed in the Korean Intellectual Property Office on Dec. 9, 2005, the entire contents of which are incorporated herein by reference.

While the present invention has been described with respect to certain preferred embodiments, it will be apparent to those skilled in the art that various changes and modifications may be made without departing from the scope of the invention as defined in the following claims.

What is claimed is:

1. An antenna system for tracking a satellite, which comprises a fixed body for transmitting and receiving communication and broadcasting signals to/from an external terminal system and receiving AC power from an external source, and a rotating body rotatably coupled to the fixed body in multi-axis directions for tracking a direction of the satellite, and transmitting and receiving signal power to/from the satellite through a free space, wherein the antenna system comprises:

a transmitting/receiving unit having a transmitting channel and a receiving channel for signal power wherein the receiving channel includes an antenna;

a driving unit for enabling mechanical motion of the rotating body for satellite tracking and comprising a plurality of motors for driving the antenna system in an azimuth direction and in an elevation direction, and rotating the antenna itself to compensate for a polarization error generated by a relative position of the antenna system to the satellite; and a control unit for monitoring and controlling the operation of the driving unit to orient the antenna system towards the satellite in real-time.

2. The antenna system as recited in claim 1, wherein the transmitting channel includes:

a rotary joint for providing a channel between the rotating body and the fixed body;

a Transceiver (TRX) common unit for controlling on and off through a built-in RF switch;

a block up converter for frequency up-converting an inputted baseband signal into an RF band signal; and a power amplifier for amplifying the RF signal from the block up converter to a high output.

3. The antenna system as recited in claim 1, wherein the receiving channel includes:

a rotary joint for providing a channel between the rotating body and the fixed body;

a low noise block for low noise amplifying signal power received through an antenna; and a TRX common unit for power-dividing the received signal through a built-in divider and outputting the divided signals to the rotary joint and the control unit, respectively, for performing demodulation of the received signal and satellite tracking by using the received signal.

4. The antenna system as recited in claim 1, wherein the plurality of motors of the driving unit includes:

an azimuth motor for driving the antenna system in the azimuth direction;

an elevation motor for driving the antenna system in the elevation direction;

an antenna rotating motor for rotating the antenna itself to compensate for the polarization error generated by the relative position of the antenna system to the satellite;

a feed horn rotating motor for compensating for a polarization angle error of the antenna system mounted on a movable body generated by irregular motion of the movable body; and a latitude compensating motor for compensating for a variation of a satellite-oriented angle of the antenna generated when the movable body on which the antenna system is mounted moves in a latitude direction.

5. The antenna system as recited in claim 1, wherein the control unit includes a sensor unit having:

a rate sensor for sensing an angular velocity to the motion of the antenna system;

a tilt sensor for sensing a tilted declination of the antenna system; and a gyrocompass for measuring an azimuth by using a magnetic operating principle, the control unit transmitting the information sensed by the rate sensor, the tilt sensor and the gyrocompass to an antenna control unit which controls the azimuth motor, the elevation motor and the antenna rotating motor contained in the driving motor based on the information so that the antenna system can be oriented toward the satellite in real time.

6. The antenna system as recited in claim 5, wherein a Global Positioning System (GPS) is installed inside or outside the sensor unit for transmitting position information from the satellite to the antenna control unit, and the antenna control unit checks a position of the antenna system and a relative direction of the satellite by using the position information, and controls the antenna rotating motor and the feed horn rotating motor for polarization control.

* * * * *